US005188236A

United States Patent [19]

Sayers et al.

[11] Patent Number: 5,188,236

[45] Date of Patent: Feb. 23, 1993

[54] SCENT SAMPLER CONSTRUCTION

[75] Inventors: Herbert M. Sayers, 9904 Old Warson Rd., St. Louis, Mo. 63124; William E. Mirgain, St. Louis, Mo.

[73] Assignee: Herbert M. Sayers, St. Louis, Mo.

[21] Appl. No.: 616,407

[22] Filed: Nov. 21, 1990

[51] Int. Cl.[5] ..... B65D 69/00; B65D 79/00; G09F 00/00

[52] U.S. Cl. ..... 206/527; 283/56; 206/527

[58] Field of Search ..... 206/204, 205, 581, 527; 428/905; 283/15.1, 56

[56] References Cited

U.S. PATENT DOCUMENTS

| | | | |
|---|---|---|---|
| 4,369,882 | 1/1983 | Schluger | 206/486 X |
| 4,606,956 | 8/1986 | Charbonneau et al. | 428/905 X |
| 4,720,417 | 1/1988 | Sweeny et al. | 428/905 X |
| 4,796,751 | 1/1989 | Madkour | 206/205 X |
| 4,817,860 | 4/1989 | Shapiro | 428/905 X |
| 4,824,143 | 4/1989 | Grainger | 283/56 |
| 4,876,136 | 10/1989 | Chang et al. | 206/385 X |
| 4,890,872 | 1/1990 | Parrotta et al. | 206/581 X |
| 4,988,557 | 1/1991 | Charbonneau | 428/905 X |
| 5,037,139 | 8/1991 | Schoenleber et al. | 283/56 |
| 5,072,831 | 12/1991 | Parrotta et al. | 206/459 X |

FOREIGN PATENT DOCUMENTS

| | | | |
|---|---|---|---|
| 3434184 | 3/1986 | Fed. Rep. of Germany | 281/38 |
| 2599716 | 12/1987 | France | 206/204 |
| 1329309 | 9/1973 | United Kingdom | 428/905 |
| 1444981 | 8/1976 | United Kingdom | 428/905 |
| 1516845 | 7/1978 | United Kingdom | 206/205 |

OTHER PUBLICATIONS

Escada brochure.
Boucheron brochure.
Ricci-Club brochure.

*Primary Examiner*—Paul T. Sewell
*Assistant Examiner*—Beth Anne Cicconi
*Attorney, Agent, or Firm*—Armstrong, Teasdale, Schlafly & Davis

[57] ABSTRACT

A scent sampler construction comprising a panel having two oppositely facing folds that divide the panel into first, second, and third segments arranged in a generally z-shaped configuration with one side of the second segment overlapping a portion of one side of the first segment in face to face relation, and the other side of the second segment overlapping a portion of one side of the third segment in face to face relation. There is releasable adhesive between the facing sides of the second and the third segments, to releasably secure the outer and intermediate segments together in face-to-face relation. There is a burstable encapsulated scent sample between the facing portions of the second and the third segments so that the separation of the facing portions of the second and third segments releases the sample scent. A method of making a scent sampler comprising the steps of applying a burstable scent sample to a continuous web, folding the web over itself along a first longitudinally extending fold line to form an integral flap that overlies the web and to sandwich the burstable scent sample between the flap and the web; folding the first fold line underneath the web along a second longitudinally extending fold line so that the burstable scent sample is below the web, and a portion of the flap remains above the web; and unfolding the portion of the flap above the web to form a z-fold in the web.

8 Claims, 3 Drawing Sheets

FIG. 1.
(PRIOR ART)
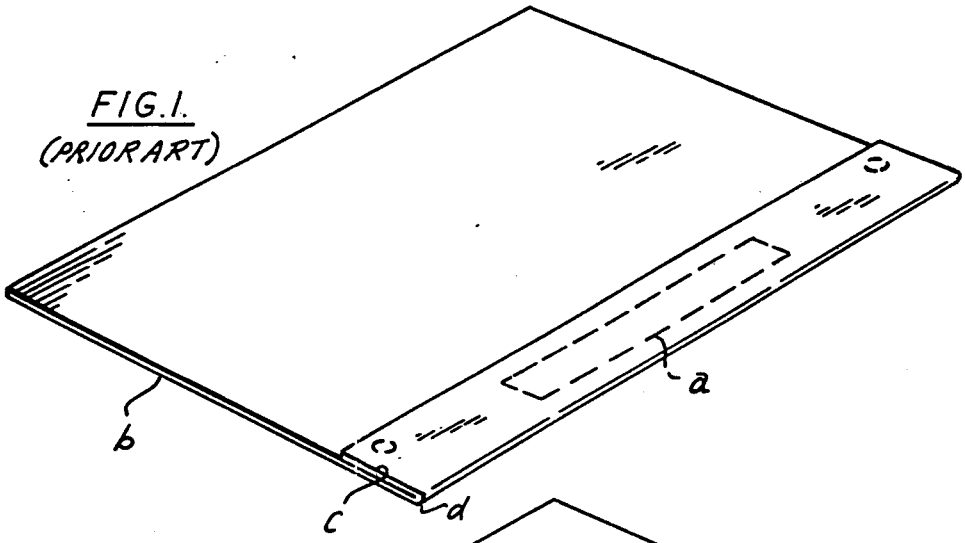
FIG. 2.
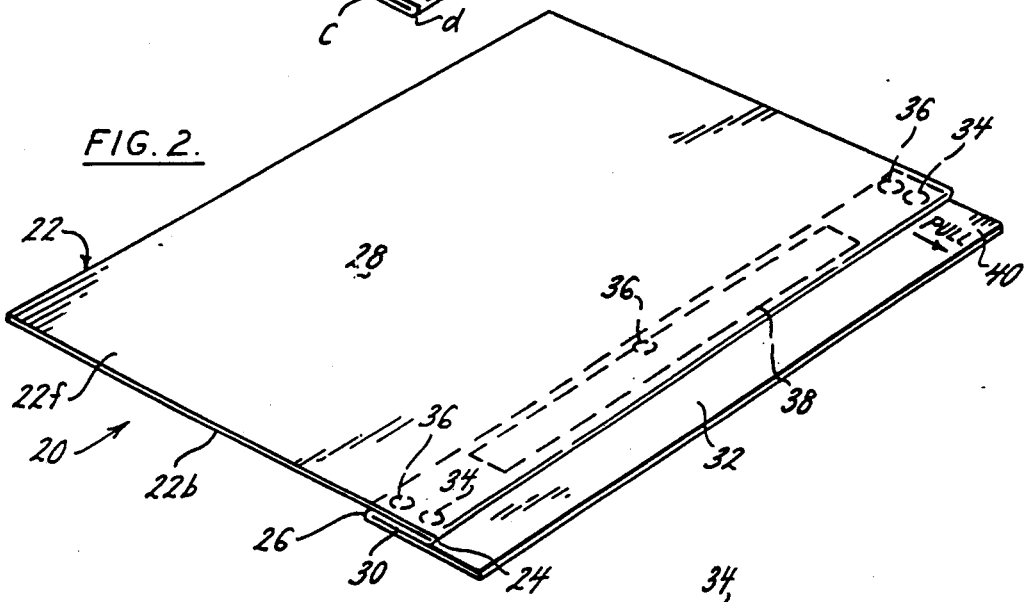
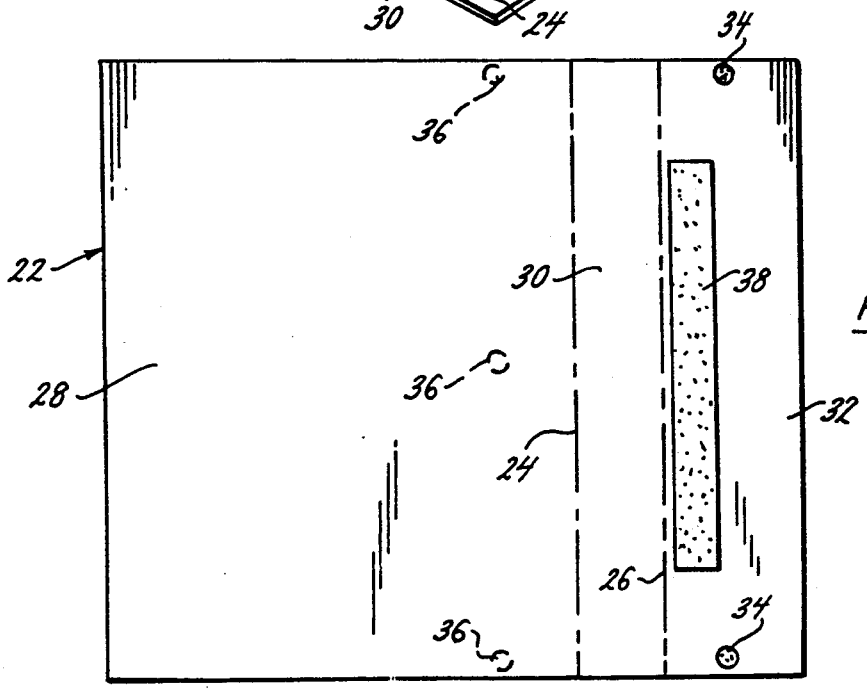
FIG. 3.

SCENT SAMPLER CONSTRUCTION

BACKGROUND OF THE INVENTION

This invention relates to a construction for delivering a sample of a scent or fragrance, such as might be used as in insert in a magazine or incorporated into a leaflet, and to a method of making such a construction.

It is common to provide samples of scents, such as perfumes and colognes, in magazine inserts, on leaflets, charge card statements, and the like. The sample (a) is typically encapsulated between the facing portions (see FIG. 1) of a sampler, which comprises a base (b) and a flap (c) formed from the base by a single fold (d) in the base. The sampler is constructed so that lifting or otherwise releasing the flap releases the sample. As a result of this simple single fold construction, the flap is relatively easy to release, and is often inadvertently released in handling the magazine or leaflet containing the sampler. The release of these strong scents has given rise to a number of complaints about scent samplers, despite their valuable and beneficial function of providing inexpensive samples of scents.

SUMMARY OF THE INVENTION

What was needed was a more secure, yet inexpensive, scent sampler construction that would resist releasing the scent until purposefully activated. The sampler should be of simple and inexpensive construction, and should be easy to operate. The sampler should also be constructed so that printing, and other graphics can be incorporated in the sampler to pique consumer interest in sampling the scent.

The scent sampler construction of the present invention is adapted to be used as a magazine insert, or incorporated as part of a leaflet, or other similar use. The scent sampler construction comprises a panel of a thin flexible sheet material having two oppositely facing folds that divide the panel into first, second, and third segments. The segments are arranged in a generally z-shaped configuration with one side of the second segment overlapping a portion of one side of the first segment in face to face relation, and the other side of the second segment overlapping a portion of one side of the third segment in face to face relation. There is releasable adhesive, preferably in the form of glue tacks, between the facing sides of the second and the third segments, to releasably secure the second and third segments together in face-to-face relation. There is also releasable adhesive, preferably in the form of glue tacks, between the facing sides of the first and the second segments, to releasably secure the first and second segments together in face-to-face relation. A burstable encapsulated scent sample is disposed between the facing portions of the second and the third segments so that the separation of the facing portions of the second and third segments releases the sample scent. The sample may be released, for example, by pulling the third segment laterally away from the first segment, simultaneously separating the second segment from both the first and the third segments, and bursting the encapsulated scent sample.

The method of making a scent sampler according to the principles of the present invention involves a continuous web of foldable sheet material. Generally, the method comprises the steps of applying a burstable scent sample to the top surface of the continuous web, generally adjacent a first side edge of the web, at longitudinally spaced intervals. The first side edge of the web is folded over itself along a first longitudinally extending fold line to form an integral flap that overlies the web and sandwiches the burstable scent sample between the flap and the web. The first longitudinally extending fold line, and the adjacent portions of the flap and web, are folded underneath the web along a second longitudinally extending fold line, so that the burstable scent sample is below the web while a portion of the flap remain above the web. The portion of the flap above the web is then unfolded to complete the z-fold in the web.

The sampler construction of the present invention is more secure than the prior art single flap constructions, and resists releasing the sample until purposefully activated. While the flap formed by a single fold over would frequently be released in normal handling of the prior art samplers, the z-folded construction is more secure, yet still of simple and inexpensive construction, and easily operated when it is intended to release the smaple. The sampler is constructed so that printing, and other graphics can be incorporated with the sampler to pique consumer interest in sampling the scent.

These and other features and advantages will be in part apparent and in part pointed out hereinafter.

BRIEF DESCRIPTION OF THE DRAWINGS

FIG. 1 is a perspective view of a prior art scent sampler;

FIG. 2 is a perspective view of a scent sampler construction constructed according to the principles of this invention;

FIG. 3 is a front elevation view of the scent sampler construction after it has been operated to release the scent sample;

Corresponding reference numerals indicate corresponding parts throughout the several views of the drawings.

DETAILED DESCRIPTION OF THE PREFERRED EMBODIMENT

Figure 4:
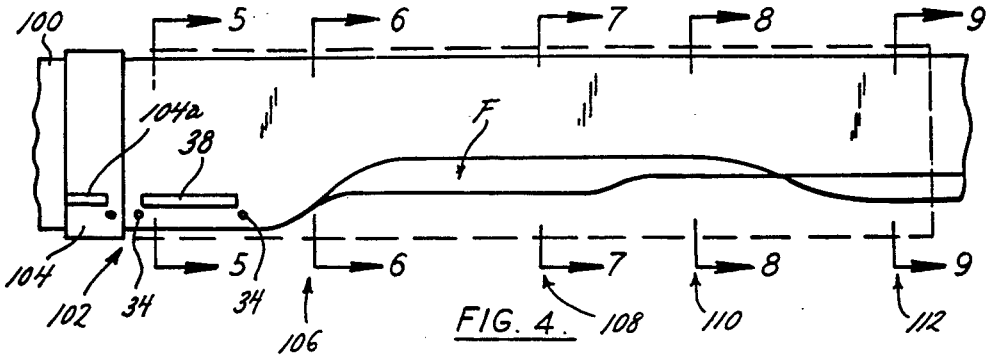
FIG. 4 is a diagrammatic view illustrating the method of making the sampler construction according to the present invention.
Figure 5:
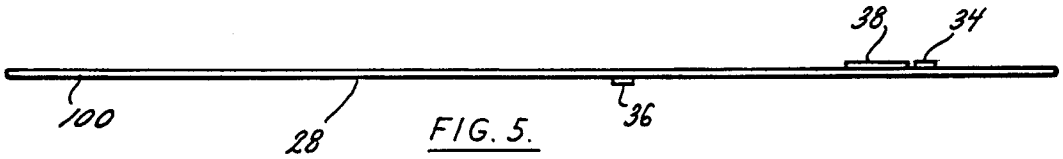
FIG. 5 is a cross-sectional view of the paper web from which the sampler construction is made, taken along the plane of line 5—5 in FIG. 4.

A scent sampler construction for providing a sample of a scent, for example in a magazine or a leaflet or the like, is indicated generally as 20 in FIGS. 2 and 3. The sampler 20 comprises a panel 22, made from a relatively thin flexible sheet material such as paper, cardboard, or plastic, having two oppositely facing folds 24 and 26, that divide the panel into a first segment 28, a second segment 30, and a third segment 32. The segments are arranged in a generally z-shaped configuration (see FIG. 2) with one side of the second segment 30 overlapping (in either overlying or underlying relationship) a portion of one side of the first segment 28 in face to face relation, and the other side of the second segment 30 overlapping (in either overlying or underlying relationship) a portion of one side of the third segment 32 in face to face relation. In this preferred embodiment, the panel has a front face 22*f* and a back face 22*b*, and the sampler 20 is configured so that the back faces of the first and second segments face each other and so that the front faces of the second and third segments face each other. Thus, in this preferred embodiment, the second segment 30 is behind the first segment 28, and the third segment 32 is behind the second segment 30.

There are adhesive tacks 34 of a releasable adhesive between the facing sides of the second segment 30 and the third segment 32, to releasably secure the second and third segments together in face-to-face relation. There are also adhesive tacks 36 of a releasable adhesive between the facing sides of the first segment 28 and the second segment 30, to releasably secure the first and second segments together in face-to-face relation.

A burstable encapsulated scent sample 38 (which samples are well known in the art), is provided between the facing portions of the second segment 30 and the third segment 32 so that the separation of the facing portions of the second and third segments releases the sample scent.

The z-shaped configuration of the sampler protects the burstable scent sample 38, which is protected between the second segment 30 and the third segment 32, and is less subject to accidental bursting during handling than prior art samplers in which the burstable sample was under a flap formed by a single fold. The adhesive tacks 34 and 36 also help maintain the z-shaped configuration of the sampler 20.

When incorporated in a magazine or leaflet, the edge of the first segment 28 opposite from the third segment 32 would typically be bound. Thus, the scent sample is located between two segments connected by an outwardly facing fold, and this is less likely to be accidentally pulled open than a sample located between two segments connected by an inwardly facing fold (e.g., the fold between the flap and the base of the prior art sampler shown in FIG. 1).

The sampler construction preferably includes indicia, such as at 40, that provides instruction on how to open the sampler and release the scent sample. More specifically the indicia may be provided on the third segment 32, instructing the user to pull the segment 32 outwardly away from the first segment 28. As the second and third segments 30 and 32 are separated, the microcapsules containing the scent are ruptured.

The method of making a scent sampler construction according to the principles of the present invention is illustrated in FIGS. 4 through 9. The scent sampler is formed from a continuous web of foldable sheet material 100, such as paper. As indicated at 102, the burstable scent samples 38 are applied to the top surface of the continuous web, for example with a custom built pattern gluer. The gluer comprises a cylinder 104 with a fragrance pad 104*a* that applies a mixture of adhesive and microencapsulated scent to the web 100. The scent samples 38 are applied generally adjacent a first edge of the web 100, at longitudinally spaced intervals. The burstable scent sample is preferably applied to the portion of the web that becomes outer segment 32. The gluer also applies glue tacks 34 to the web 100. The glue tacks 34 are applied to the portion of the web that becomes the outer segment 32, and to the portion of the web that becomes the intermediate segment 30. These glue tacks are positioned so that when the segments are folded together, as described below, the glue tacks adhere to each other.

Figure 6:
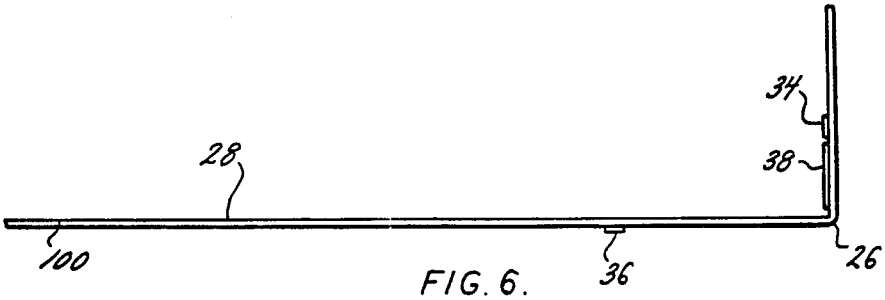
FIG. 6 is a cross-sectional view of the paper web from which the sampler construction is made, taken along the plane of line 6—6 in FIG. 4.
Figure 7:
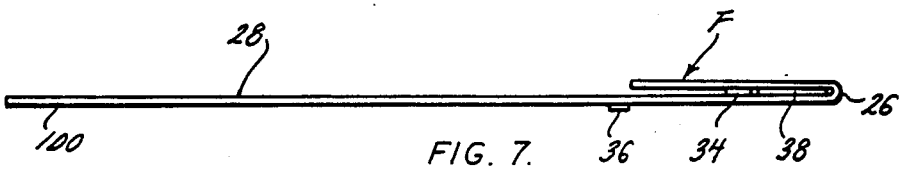
FIG. 7 is a cross-sectional view of the paper web from which the sampler construction is made, taken along the plane of line 7—7 in FIG. 4.

The first side edge of the web is folded up, as shown at 106 in FIG. 4 and in FIG. 6. This is accomplished with a rotary plow. The first side edge is then folded over the web, as shown at 108 in FIG. 4 and in FIG. 7, along a first longitudinally extending fold line 26 to form an integral flap F that overlies the web and sandwiches the burstable scent sample 38 between the flap F and the web. The flap F is the width of the third segment 32, and becomes the third segment 32 in the finished construction. When the flap F is folded over the web, the glue tacks 34 on what will become the second segment 30 and the third segment 32 adhere to secure the flap over the portion of the web that will become the second segment 30. Thus, the burstable scent sample 38 is sandwiched between what will become the second segment 30 and the third segment 32.

At this point, glue tacks 36 may be applied to the underside of the web 100, preferably to the portion that will become the first segment 28. This is conveniently done with a spot gluer.

Figure 8:
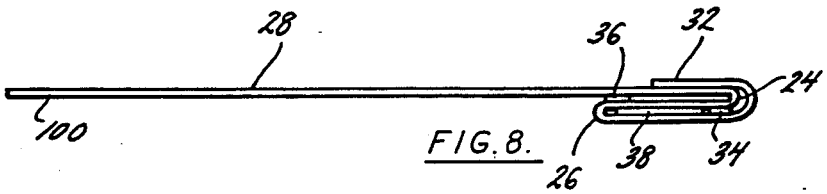
FIG. 8 is a cross-sectional view of the paper web from which the sampler construction is made, taken along the plane of line 8—8 in FIG. 4.

At 110 in FIG. 4, the first longitudinally extending fold line 26, and the adjacent portions of the flap F and web 100, i.e., what will become a portion of the third segment 32 and what will become the entire second segment 30, are folded underneath the web along a second longitudinally extending fold line 24. This is conveniently done with a rotary plow and a gooseneck plow assist. Thus the burstable scent sample 28, which is between facing portions of the second segment 30 and the third segment 32, is below the web 100, while the remaining portion of what will become the third segment 32 still overlies the top surface of the web, as shown in FIG. 8. The glue tacks 36 on the underside of the first segment 28 releasably adhere to the second segment 30, as these segments are folded together, releasably securing the first and second segments together.

Figure 9:
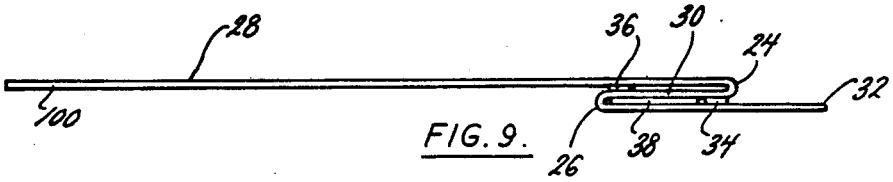
FIG.9 is a cross-sectional view of the paper web from which the sampler construction is made, taken along the plane of line 9—9 in FIG. 4.
Figure 10:
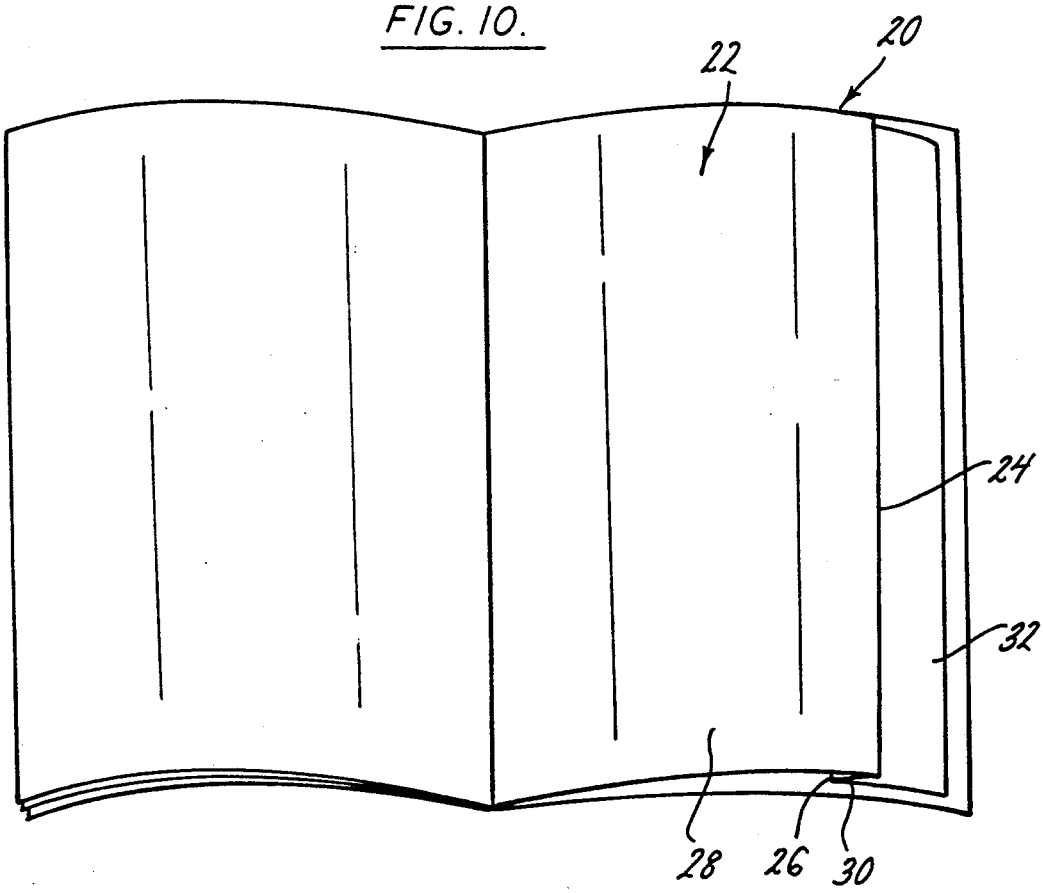
FIG. 10 is a top plan view of a magazine or leaflet incorporating a sampler constructed according to the principles of this invention.

At 112, the portion of the third segment 32 that was overlying the top of the web 100 is unfolded so that the web takes on its completed z-shaped configuration, as shown in FIG. 9, with the back sides of the first segment 28 and the second segment 30 in face to face relationship, and the front sides of the second segment 30 and the third segment 32 in face to face relationship. This is conveniently done with a second gooseneck plow assist. The web is then cut to separate the individual scent sampler constructions.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. An improved scent sampler construction of the type comprising a burstable scent sample between two opposing segments of a panel, for providing a sample of a scent, the improvement comprising:

the scent sampler having a generally z-shaped configuration, formed by two oppositely facing folds which define a first segment, a second segment, and a third segment, in the panel, one face of the second segment overlapping a portion of one face of the first segment, and the other face of the second segment overlapping a portion of one face of the third segment, and wherein the burstable scent sample is located entirely between facing portions of the second segment and the third segment, the panel being folded so that the first segment is wider than the third segment, and the third segment is wider than the second segment.

2. In combination with a magazine or leaflet, an improved scent sampler construction of the type comprising a burstable scent sample between two opposing segments of a panel, for providing a sample of a scent, the improvement comprising:

the scent sampler having a generally z-shaped configuration, formed by two oppositely facing folds which define a first segment, a second segment, and a third segment, in the panel, one face of the second segment overlapping a portion of one face of the first segment, and the other face of the second segment overlapping a portion of one face of the third segment, and wherein the burstable scent sample is located entirely between facing portions of the second segment and the third segment, the edge of first segment opposite from the second and third segments being bound into the magazine or leaflet.

3. An improved scent sampler construction of the type comprising a burstable scent sample between two opposing segments of a panel having a front face and a back face, for providing a sample of a scent, the improvement comprising:

the scent sampler having a generally z-shaped configuration, formed by two oppositely facing folds which define a first segment, a second segment, and a third segment, in the panel, one face of the second segment overlapping a portion of one face of the first segment, and the other face of the second segment overlapping a portion of one face of the third segment, and wherein the burstable scent sample is located entirely between facing portions of the second segment and the third segment, the folds being configured so that the third segment is behind the first segment and so that the first segment is wider than the third segment, and the third segment is wider than the second segment.

4. In combination with a magazine or leaflet, an improved scent sample construction of the type comprising a burstable scent sample between two opposing segments of a panel having a front face and a back face, for providing a sample of scent, the improvement comprising:

the scent sampler having a generally z-shaped configuration, formed by two oppositely facing folds which define a first segment, a second segment, and a third segment, in the panel, one face of the second segment overlapping a portion of one face of the first segment, and the other face of the second segment overlapping a portion of one face of the third segment, and wherein the burstable scent sample is located entirely between facing portions of the second segment and the third segment, the folds being configured so that the third segment is behind the first segment, the edge of first segment opposite from the second and third segments being bound into the magazine or leaflet.

5. A scent sampler construction for providing a sample of a scent, the construction comprising:

a panel having two oppositely facing folds that divide the panel into first, second, and third segments arranged in a generally z-shaped configuration with one side of the second segment overlapping a portion of one side of the first segment in face to face relation, and the other side of the second segment overlapping a portion of one side of the third segment in face to face relation;

releasable adhesive between the facing sides of the second and the third segments, to releasably secure the third and second segments together in face-to-face relation; and a burstable encapsulated scent sample located entirely between the facing portions of the second and the third segments so that the separation of the facing portions of the second and third segments releases the sample scent, the panel being folded so that the first segment is wider than the third segment, and the third segment is wider than the second segment.

6. In combination with a magazine or leaflet, a scent sampler construction for providing a sample of a scent, the construction comprising:

a panel having two oppositely facing folds that divide the panel into first, second, and third segments arranged in a generally z-shaped configuration with one side of the second segment overlapping a portion of one side of the first segment in face to face relation, and the other side of the second segment overlapping a portion of one side of the third segment in face to face relation;

releasable adhesive between the facing sides of the second and the third segments, to releasably secure the third and second segments together in face-to-face relation; and a burstable encapsulated scent sample located entirely between the facing portions of the second and the third segments so that the separation of the facing portions of the second and third segments releases the sample scent, the edge of first segment opposite from the second and third segments being bound into the magazine or leaflet.

7. A scent sampler construction for providing a sample of a scent, the construction comprising:

a panel having two oppositely facing folds that divide the panel into first, second, and third segments arranged in a generally z-shaped configuration with one side of the second segment overlapping a portion of one side of the first segment in face to face relation, and the other side of the second segment overlapping a portion of one side of the third segment in face to face relation;

releasable adhesive between the facing sides of the second and the third segments, to releasably secure the third and second segments together in face-to-face relation;

releasable adhesive between the facing sides of the first and second segments, to releasably secure the first and second segments together in face-to-face relation; and a burstable encapsulated scent sample located entirely between the facing portions of the second and the third segments so that the separation of the facing portions of the second and third segments releases the sample scent, the panel being folded so that the first segment is wider than the third segment, and the third segment is wider than the second segment.

8. In combination with a magazine or leaflet, a scent sampler construction for providing a sample of a scent, the construction comprising:

a panel having two oppositely facing folds that divide the panel into first, second, and third segments arranged in a generally z-shaped configuration with one side of the second segment overlapping a portion of one side of the first segment in face to face relation, and the other side of the second segment overlapping a portion of one side of the third segment in face to face relation;

releasable adhesive between the facing sides of the second and the third segments, to releasably secure the third and second segments together in face-to-face relation;

releasable adhesive between the facing sides of the first and second segments, to releasably secure the first and second segments together in face-to-face relation; and a burstable encapsulated scent sample located entirely between the facing portions of the second and the third segments so that the separation of the facing portions of the second and third segments releases the sample scent, the edge of first segment opposite from the second and third segments being bound into the magazine or leaflet.

* * * * *